United States Patent [19]

Kamp et al.

[11] Patent Number: 4,881,914

[45] Date of Patent: Nov. 21, 1989

[54] GETTER ARRANGEMENT HAVING A GETTER DETECTOR AND A POST-HEATING TIMER

[75] Inventors: Ronald P. T. Kamp; Johannes P. De Meij, both of Eindhoven, Netherlands

[73] Assignee: U.S. Philips Corporation, New York, N.Y.

[21] Appl. No.: 278,884

[22] Filed: Dec. 1, 1988

[30] Foreign Application Priority Data

Dec. 16, 1987 [NL] Netherlands ..... 8703042

[51] Int. Cl.[4] ..... H01J 7/18

[52] U.S. Cl. ..... 445/73; 445/19; 445/55; 445/63

[58] Field of Search ..... 445/9, 19, 29, 31, 38, 445/41, 55, 63, 73

[56] References Cited

U.S. PATENT DOCUMENTS

| | | | |
|---|---|---|---|
| 2,979,371 | 4/1961 | Spalding | 445/55 |
| 4,302,063 | 11/1981 | Rudy | 445/19 |
| 4,494,042 | 1/1985 | Roche | 445/73 |
| 4,516,945 | 5/1985 | Martelli | 445/19 |
| 4,584,449 | 4/1986 | Timmons | 445/19 |
| 4,668,203 | 5/1987 | Giudici | 445/55 |

FOREIGN PATENT DOCUMENTS

| | | | |
|---|---|---|---|
| 0184239 | 10/1983 | Japan | 445/63 |
| 0081845 | 5/1984 | Japan | 445/55 |

*Primary Examiner*—Kurt Rowan

*Attorney, Agent, or Firm*—Robert J. Kraus

[57] ABSTRACT

In a getter arrangement for providing a getter spot on the wall of an evacuated space, for example an electron tube, the power transfer can be of too short or too long a duration (for example because of positional inaccuracies of the holder containing the getter material or inaccuracies in the shape or composition of the wall). In the first case the intended quality of the getter process is not obtained, in the second case the electron tube may get damaged. A control unit measures the duration of the time interval which starts at the beginning of the power transfer and ends at the instant the getter spot is created. This instant is determined by a detector which detects the getter spot. After this instant the control unit continues the power transfer during a further time interval whose length depends on the first time interval. Consequently, the duration of the transfer depends on the behaviour of the gettering process, which improves the quality of the gettering process and prevents damage to the tube.

5 Claims, 3 Drawing Sheets

GETTER ARRANGEMENT HAVING A GETTER DETECTOR AND A POST-HEATING TIMER

BACKGROUND OF THE INVENTION

The invention relates to a getter arrangement for providing a getter spot on a getter surface within an evacuated space by evaporating getter material arranged near the getter surface, the getter arrangement including getter means situated outside the evacuated space for within this space in the region of the getter material generating a heating power for evaporating the getter material, the getter arrangement further including a control unit for controlling the heating power, the control unit having detection means for detecting the presence of the getter spot on the getter surface.

Such a getter arrangement is disclosed in the "Abstract" of the Japanese Patent Application number 58-247309, publication number 60-143546.

The vacuum in an evacuated space can be improved by providing a getter spot therein. This is effected by positioning in the evacuated space a holder which contains a predetermined quantity of getter material to be evaporated. This holder is arranged quite near to a getter surface, that is to say the area on which the getter spot is to be provided. Generally, an inner wall of the evacuated space is chosen for this purpose. The holder, which, is for example, in the shape of a ring, can, for example, be heated inductively by placing a highfrequency induction coil near the holder, but outside the evacuated space. This induction coil is connected to a high-frequency generator.

The holder may alternatively be heated by different heating means, for example by radiating visible or non-visible laser light into the holder, the laser light being produced by a power laser.

As soon as the getter material starts to evaporate it is deposited on the wall of the evacuated space and forms a getter spot there, thereby binding the residual gases still present. The metal barium is often used as the getter material.

The above-described gettering procedure is, for example, used during the production of vacuum electron tubes. Such a tube is first evacuated and sealed thereafter. When induction heating is applied, the holder cum getter material is provided in the tube near the glass wall, to ensure that the largest possible portion of the electromagnetic flux generated by the high-frequency induction coil will be encompassed by the annular holder, so that the high-frequency heating process occurring there will be as optimal as possible.

Because of the unavoidable inaccuracies in the positioning of the annular holder containing the getter material, relative to the high-frequency induction coil, the flux encompassed by the annular holder will vary from case to case. At a substantially constant high-frequency heating powder produced by the high-frequency generator too little getter material would be evaporated in an annular holder encompassing a low amount of flux in a predetermined period of time, and in an annular holder encompassing much flux the annular holder would become too hot causing, by melting, metal particles to be deposited freely in the evacuated space so that the components present there might get contaminated. In the first case the desired quality of the getter process is not achieved, in the second case the tube might be damaged.

The holder containing the getter material can also be heated by means of laser light. Positional inaccuracies of the holder might cause a non-uniform temperature distribution at a non-recurrently chosen fixed arrangement of the laser. In that case too small a portion of the getter material would evaporate in the coolest spot of the holder, whereas the above-described disadvantages may occur in the hottest spot. In addition, inaccuracies in the shape of the wall of the evacuated space or contaminations in this wall, for example air bubbles, may effect dispersion or absorption of the laser beam as result of which less heating power is applied to the holder than was originally the intention. This also causes the problems described in the foregoing for inductive heating.

These problems might be solved by using a much more accurate positioning of the holder, by smaller tolerances in the shape of the electron tube and by chosing material of a higher grade for the glass wall of the tube. This is however a costly solution.

SUMMARY OF THE INVENTION

The invention has for its object to evaporate a predetermined quantity of getter material irrespective of the position of the holder cum getter material within the evacuated space.

According to the invention, the getter arrangement is therefore characterized in that

- the heating means are arranged for producing a substantially constant heating power;
- the control unit further includes:
  - a timer connected to the detection means for measuring a first time interval from the beginning of the transfer of the heating power to detection of the getter spot;
  - a time interval generator connected to the timer for generating a second time interval which is contiguous to the first time interval and whose length is determined by the first time interval, the time interval generator producing a switch-off signal at the end of the second time interval;
- the getter arrangement includes switching means for switching-off the supply of power to the getter material in response to the switch-off signal.

The invention is based on the recognition that at the beginning of the formation of the getter spot only a small portion of the getter material has evaporated and that a short heating-up period implies that the holder receives much heating power, so that also a short post-heating period is required. On the other hand, a long heatingup period implies that the holder receives little heating power so that also a long post-heating period is required. Heating-up period must be understood to mean the time elapsed from the beginning of the supply of the heating power to the beginning of the formation of the getter spot. Post-heating period must be understood to mean the time the heating power must be applied from the beginning of the formation of the getter spot to the instant at which the predetermined quantity of getter material has evaporated.

By measuring, using the timer, the heating-up period until the beginning of the formation of the getter spot and to generate, by means of the time interval generator, the associated time interval for the post-heating period, the predetermined quantity of getter material can be deposited onto the getter surface in a simple and reproducable manner.

The getter arrangement is further characterized in that the detection means comprises a light source and a light detector;

the light source is positioned at one side of the intended position of the cylinder during the getter process, the light source being arranged for transmitting a light beam through the cylinder wall at a small angle to the wall;

the light detector is placed at the other side of the intended position of the cylinder, the light-sensitive input of the light detector receiving the light beam emanating from the cylinder.

With this arrangement, when inductive heating is used, the induction coil is positioned against the wall of the electron tube opposite the holder cum getter material provided in the electron tube, such that the holder comprises the highest possible quantity of electromagnetic flux transmitted by the high-frequency induction coil. The light source is positioned at one side of the induction coil and the electron tube, the light detector is positioned at the other side of the induction coil and the electron tube, opposite the light source.

The light source must be positioned such that the light beam coming from the light source is incident on the surface of the electron tube wall at a small angle. Thereafter the light beam is to pass through the wall of the electron tube and to emerge such from the interior side of this wall that the light beam travels closely along the interior side of the wall in this space, to re-enter the wall thereafter in an opposite position and thereafter to re-emerge at the exterior side of the wall in substantially the same direction as the incident light beam. The light detector must be positioned such that the emerging light beam can enter the light-sensitive input of the light detector.

If in this position of the detection means a getter spot is formed on the getter surface, the light path between the light source and the light detector will be interupted by the getter spot.

The advantage of this way of positioning is that the light beam grazes along the interior side of the wall of the evacuated space so that unwanted reflections from and absorptions by components in the electron tube cannot occur. Moreover, for the case of inductive heating, the induction coil can be positioned as closely as possible against the electron tube wall because the light source is provided at one side and the light detector at the other side of the high-frequency induction coil. This renders a high-frequency power transfer possible with a minium of loss of flux.

BRIEF DESCRIPTION OF THE DRAWING

The invention will now be described in greater detail by way of example with reference to the embodiment shown in the accompanying Figures.

Therein.

DESCRIPTION OF THE PREFERRED EMBODIMENTS

To illustrate the invention, a description on the basis of an inductive heating arrangement is opted for. It should however be noted that it is alternatively equally possible to effect heating of the getter material in according with a different heating method, such as, for example, heating by means of a power laser.

Figure 1:
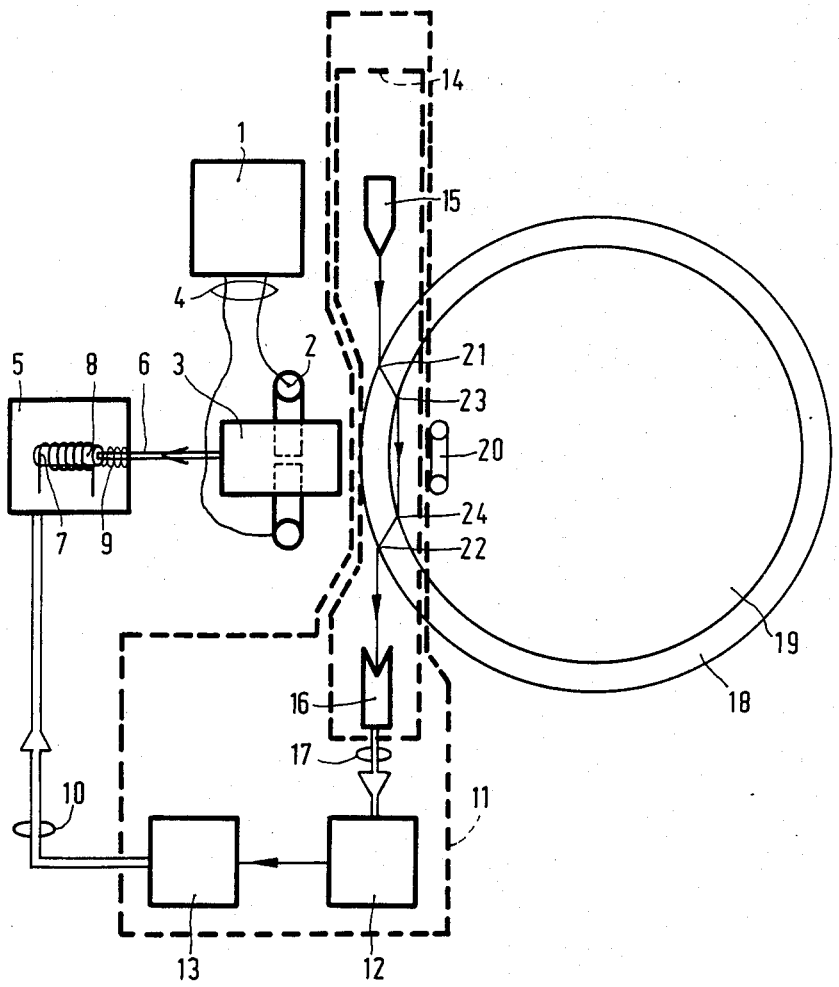
FIG. 1: is a general view of the getter arrangement according to the invention.

The getter arrangement shown in FIG. 1 comprises a high-frequency generator 1 which is connected via a pair of wires 4 to the induction coil 2 which has a high-permeability coil core 3. This coil core 3 is coupled mechanically, for example by means of a rod 6, to switching means 5. The switching means 5 is formed by a spring 9 and an electro magnet which is constituted by an energizing coil 7 and a core 8. The energizing coil 7 is connected to a control unit 11 via a pair of wires 10. The control unit 11 includes detection means 14, a timer 12 and a time interval generator 13 connected to the timer 12, the time interval generator 13 being coupled to the energizing coil 7 via the pair of wires 10.

A holder 20 containing getter material is disposed in an evacuated space 19, for example the neck of a cathode ray tube, the evacuated space 19 being bounded by a glass wall 18.

The detection means 14 are formed by a light source 15 and a light detector 16, the light detector 16 being connected to the timer 12 via a pair of wires 17.

This light source 15 is positioned before the front face and aside the centre of he coil core 3 and the light-sensitive input of the light detector 16 is also provided before the front face of the coil core 3 but at the other side of the centre of the coil core 3.

The light source 15 may, for example, be constituted by a laser in combination with an optical fibre, the end of the optical fibre then functioning as a light source. Likewise, the light detector 16 may be combined with an optical fibre, the leading end of the optical fibre then functioning as a light-sensitive input of the detector. This combination has the advantage that the use of optical fibres renders it possible to position the actual light source 15 and the actual light detector 16 including their supply and signal wires further away from electro-magnetic disturbance sources provided in the getter arrangement, such as, for example, the induction coil 2 and the high-frequency generator 1. Optical fibres are insensitive to these disturbance sources. In addition, optical fibres need little space, so that the axially movable coil core 3 can be positioned close to the wall 18 of the evacuated space 19. This renders the inductive power transfer to the holder 20 cum getter material possible with a minimum of flux loss.

The light beam originating from light source 15 is incident in a point 21 at a small angle on the glass wall 18 of the evacuated space 19. This light beam emerges from the wall 18 in a point 23 at the interior side and passes through the evacuated space 19 and thereafter re-enters the wall 18 in a point 24. In a point 22 this light beam emerges from the wall 18 at the exterior side to re-enter thereafter the light-sensistive input of the detector 16.

The light source 15 and the light detector are rigidly interconnected. The construction thus formed is provided capable of movement against a slight spring pressure in the position where the cathode ray tubes are gettered. The light source 15 and the light detector 16 have always for every cathode ray tube from one batch, the same position relative to the tube, irrespective of positional and shape variations between the individual tubes.

Figure 2:
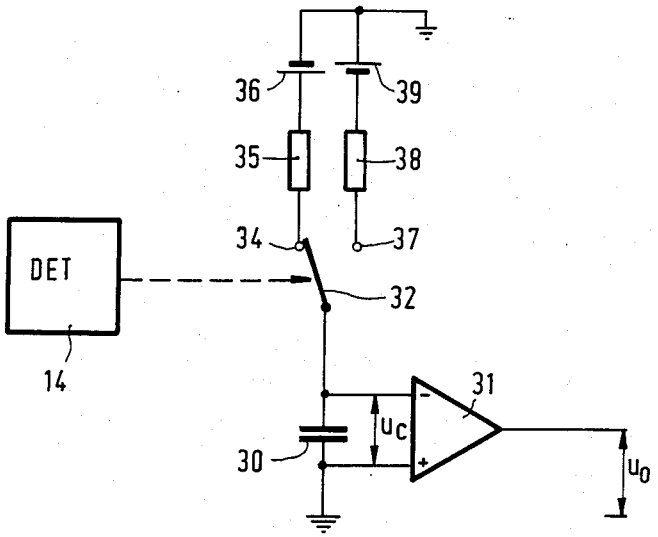
FIG. 2: is a circuit-diagram of the timer and the time interval generator according to the invention.

The circuit-diagram of the timer and the time interval operator according to the invention, shown in FIG. 2, includes a capacitor 30 which has one side connected to ground. The other side of capacitor 30 is connected to a change-over switch 32, a selection contact 34 of which is connected to the positive pole of a first constant-voltage source 36 via a resistor 35. The negative pole of this source 36 is connected to ground. The other selection contact 37 of change-over switch 32 is connected to the negative pole of a second constant-voltage source 39 via a resistor 38. The positive pole of this source 39 is connected to ground.

Figure 3A:
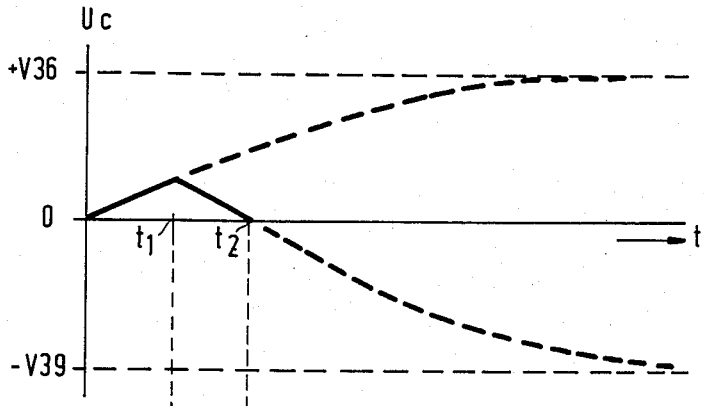
FIG. 3A: shows the variation of the voltage across the time-determining capacitor in the timer and the time interval generator according to the invention.
Figure 3B:
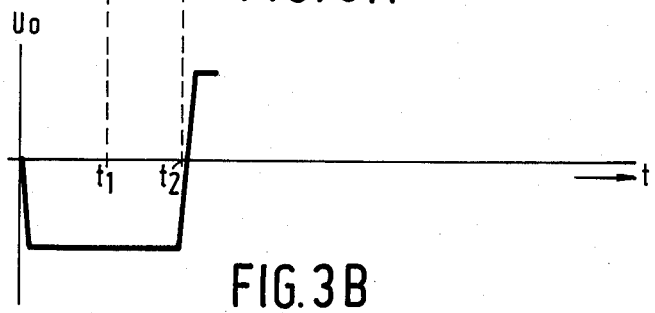
FIG. 3B: shows the variation of the output voltage of the comparator in the timer and the time interval generator according to the invention.

The change-over switch 32 is controlled by the detection means 14 which have already been described with reference to FIG. 1. The inputs of a comparator 31 are connected across the capacitor 30. The voltage Uc across the capacitor 30 and the output voltage Uo of the comparator 31 are shown in FIGS. 3A and 3B, respectively.

Let it be assumed that at the start of the heating process the capacitor 30 is in the discharged state and that the changeover switch 32 is in the position shown, so that the capacitor starts charging with a first time constant via the resistor 35 and the positive pole of the constant-voltage source 36. As the voltage at the inverting input of the comparator 31 becomes positive, the output voltage of this comparator becomes negative.

As soon as the detector means 14 detects at instant t1 the appearance of the getter spot, the detection means 14 produces a signal in response to which the change-over switch 32 switches from selector contact 34 to selector contact 37. This causes the capactitor 30 to be connected via the resistor 38 to the negative pole of the constant-voltage source 39, whose positive side is connected to ground. This causes the capacitor 30, which was just charged with a first time constant to discharge via the resistor 38 with a second time constant.

When at the instant t2 the capacitor voltage passes through zero, the output voltage of the comparator 31 will become positive.

As will be described in greater detail with reference to FIG. 4, the fact that the output voltage of the comparator 31 becomes positive results in the control unit 11 being reset to the output state and the getter arrangement thus being prepared for a subsequent gettering cycle.

Figure 4:
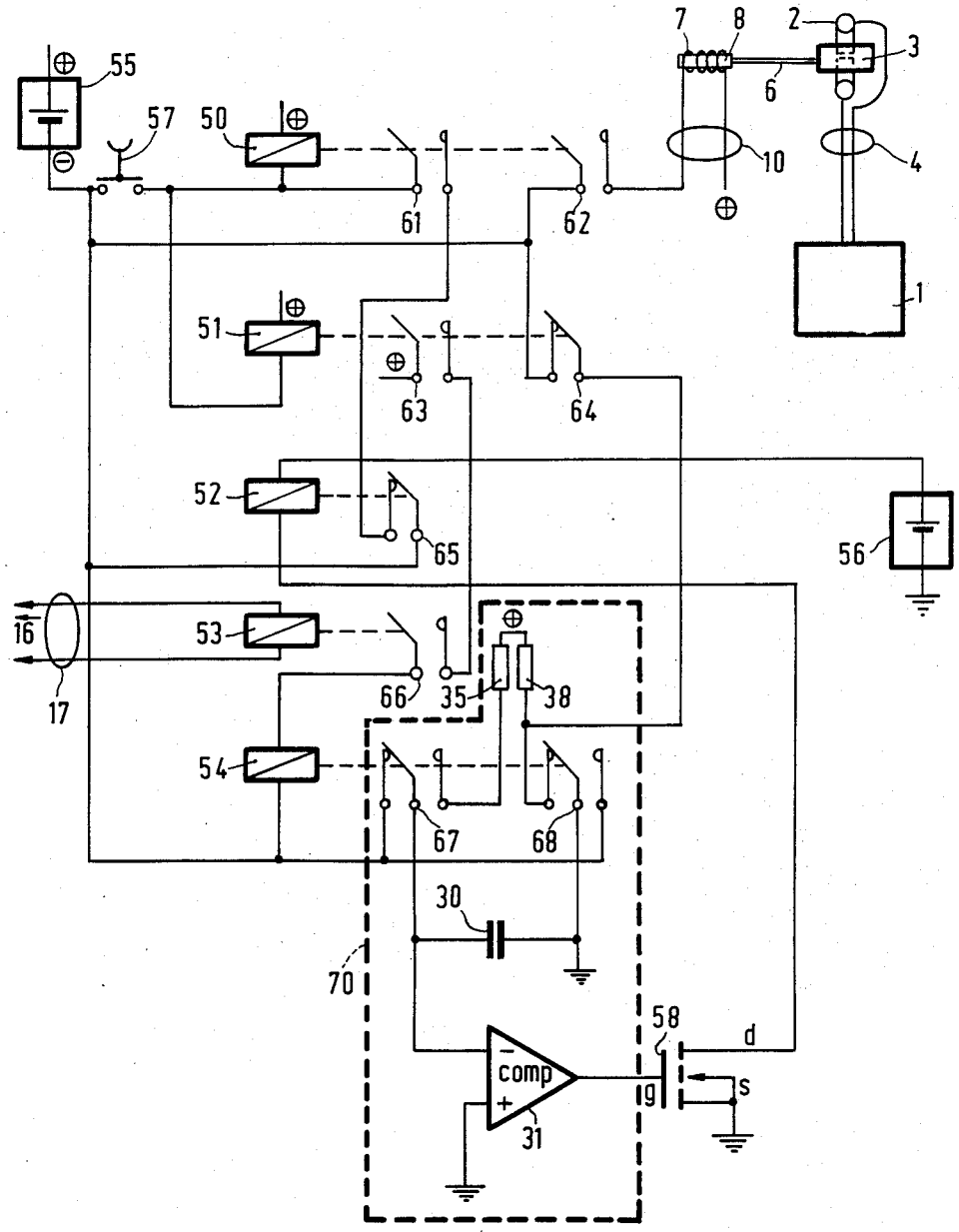
FIG. 4: is a circuit-diagram of the control unit in accordance with the invention.

The circuit-diagram of the control unit 11 shown in FIG. 4, includes a circuit 70. This circuit is a variation of the circuit already described with reference to FIG. 2. The circuitdiagram further includes five relays. The first relay is formed from relay coil 50 and two relay make contacts 61 and 62. The second relay is formed from relay coil 51 and two associated relay contacts, namely the relay make contact 63 and the relay break contact 64. The third relay is formed from relay coil 52 and the associated relay break contact 65. The fourth relay is assembled from relay coil 53 and the associated relay make contact 66. The fifth relay is assembled from relay coil 54 and the two associated relay switching contacts 67 and 68. The circuit-diagram of the control unit 11, shown in FIG. 4, further includes one electrically floating constant-voltage source 55 and one constant-voltage source 56 whose negative pole is connected to ground. In addition, the circuit-diagram has a switching transistor 58 whose gate is connected to the output of comparator 31. Furthermore, energizing coil 7 and the core 8 incorporated therein, which is mechanically connected to the coil core 3 via rod 6, are shown. This coil core 3 is capable of moving in induction coil 2, the induction coil 2 being connected via the pair of wires 4 to the high-frequency generator described with reference to FIG. 1.

The negative pole of source 55 is connected via a starter push-button contact 57, which becomes conductive when it is activated, to the relay coils 50 and 51. The negative pole of source 55 is directly connected to the relay coils 53 and 54. The other sides of the relay coils 50 and 51 are connected to the positive pole of source 55, as is shown symbolically in the Figure by a plus sign placed at both the positive pole of source 55 and at the postive sides of the relay coils. The other side of relay coil 54 is also connected to the positive pole of source 55 via the relay make contacts 66 and 63. Relay coil 53 is connected to the light detector 1 via the pair of wires 17, one wire of which is connected to the negative pole of source 55. Relay coil 52 has one side connected to the positive pole of source 56, by means of its other side relay coil 52 is connected to the drain of the switching transistor 58, the transistor 58 having its gate connected to the output of comparator 31 and its source to ground.

All the relay contacts shown in FIG. 4 are shown in the quiescent condition, that is to say that the relay contacts are in the position as shown in the drawing if no current flows through the relay coils. If the light detector 16, which is not shown in FIG. 4, detects the light beam transmitted by the light source 14, current starts to flow through relay coil 53, in response to which the relay make contact 66 becomes conductive. The capacitor 30 is short-circuited because of the fact that the relay switching contacts 67 and 68 and the relay break contact 64 are in the position shown in the drawing.

If now the starter push-button contact 57 is activated, current starts to flow through the relay coils 50 and 51, causing the relay make contacts 61, 62 and 63 to become conductive and the relay break contact 64 to be adjusted to the non-conducting state. Because of the fact that the relay make contact 61 is conductive, current continues to flow throught the relay coils 50 and 51, even if the starter pushbutton contact 57 is de-activated. Because of the fact that relay make contact 62 is conductive, current starts to flow through energizing coil 7, causing the core 8 to move. The core coil 3 which is mechanically coupled to core 8 via rod 6 now moves to a position within the induction coil 2, and pushes up to the wall 18 of the evacuated space 19. This starts the inductive power transfer of the high-frequency generator 1 via the induction coil 2 and the coil core 3 to the holder 20 containing the getter material, as described with reference to FIG. 1. Because of the fact, as mentioned in the forgoing, that relay break contact 64 is adjusted to the non-conductive state, the short-circuit of the capacitor 30 is removed. In response to the fact that the relay make contact 63 becomes conductive, current starts to flow through relay coil 54, since the relay make contact 66 is conductive. By energizing relay coil 54 the relay switching contacts 67 and 68 are changed-over and the capacitor 30 starts charging in the direction of the positive voltage of source 55 as the negative pole of source 55 is connected to ground via relay switching contact 68 (which is now in the position not shown).

The charging procedure of capacitor 30 is described with reference to the FIG. 2 and 3. During charging, that side of capacitor 30 that is connected to the inverting input of the comparator 31 becomes positive with respect to ground, causing the output voltage of comparator 31 to be negative, as a result of which the switching transistor 58 is in the non-conducting state. Consequently, no current flows throught the relay coil 52 which is arranged in series with the switching transistor 58, which has for its result that the relay break contact 65 remains conductive. The capacitor 30 continues charging until (because of the above-described interruption of the light path in the detection means 14) no current flows anymore through relay coil 53, so that the relay make contact is adjusted to the non-conducting state. As a result thereof no current flows anymore through the relay coil 54 arranged in series therewith, causing the relay switching contacts 67 and 68 to change-over so that they are again in the position shown. In response to this switching action of the relay switching contacts 67 and 68 the capacitor starts to discharge towards the negative supply voltage of source 55. The positive pole of source 55 is connected via relay switching contact 68 and via resistor 38 to ground, as the relay switching contact is now in the position shown. The inductive power transfer then still continues.

When the voltage a cross the capacitor 30 passes through zero from its positive value, the output voltage of the comparator 31 becomes positive with respect to ground, causing the switching transistor 58 to become conductive. As a result thereof current starts to flow through a relay coil 52 and the associated relay break contact 65 is adjusted to the non-conductive state, as a result of which no current flows anymore through the relay coils 50 and 51. As a result thereof the relay make contact 62 is adjusted to the non-conductive position and consequently no current flows through the energizing coil 7, causing core 8 to move back and consequently the mechanically coupled coil core 3 to retract from induction coil 2. This stops the inductive power transfer. In addition, the capacitor 30 is short-circuited again because of the fact the relay break contact 64 becomes conductive again.

The switching transistor 58 is then adjusted to the nonconductive state, because the voltage at the inverting input of the comparator 31 becomes zero. Now no current can flow any more through the relay coil 52, and the relay break contact 65 becomes conductive. The entire circuit is now in the quiescent state again, since all the relay coils are again currentless and the capacitor 30 has discharged because it is in the short-circuited state.

What is claimed is:

1. A getter arrangement for providing a getter spot on a getter surface within an evacuated space by evaporating getter material arranged near the getter surface, the getter arrangement including heating means situated outside the evacuated space for within this space in the region of the getter material generating a heating power for evaporating the getter material, the getter arrangement further including a control unit for controlling the heating power, the control unit having detection means for detecting the presence of the getter spot on the getter surface, characterized in that:

the heating means are arranged for producing a substantially constant heating power, the control unit further includes:

a timer connected to the detection means for measuring a first time interval from the beginning of the transfer of the heating power to detection of the getter spot;

a time interval generator connected to the timer for generating a second time interval which is contiguous to the first time interval and whose length is determined by the first time interval, the time interval generator producing a switch-off signal at the end of the second time interval;

the getter arrangement includes switching means for switching-off the supply of power to the getter material in response to the switch-off signal.

2. A getter arrangement as claimed in claim 1 for use in an evacuated space having round walls, characterized in that:

the detection means comprise a light source and a light detector;

the light source is placed at one side of the intended position of the cylinder during the gettering process, the light source being arranged for transmitting a light beam through the cylinder wall at a small angle to the wall;

the light detector is positioned at the other side of the intended position of the cylinder, the light-sensitive input of this light detector receiving the light beam emanating from the cylinder.

3. A getter arrangement as claimed in claim 1, characterized in that the timer and the time interval generator are together constituted by a circuit in which a capacitor is interposed between a reference potential and the main contact of a switch controlled by the detection means, the selector contacts of the switch each being coupled to its own source of constant voltage via a resistor and that the inputs of a comparator are connected across the capacitor, the output signal of this comparator constituting the switch-off signal.

4. A getter arrangement as claimed in claim 1 in which the heating means are constituted by a high-frequency generator and a highfrequency induction coil connected to the high-frequency generator, characterized in that the switching means are constituted by a coil core with high-magnetic permeability which is axially movable in the induction coil under the control of the switch-off signal.

5. A control unit designed for use in a getter arrangement as claimed in claim 1, 2 or 3.

* * * * *